US010568166B2

(12) United States Patent
Hirota et al.

(10) Patent No.: US 10,568,166 B2
(45) Date of Patent: Feb. 18, 2020

(54) INDUCTION HEATING DEVICE FOR METAL STRIP

(71) Applicant: NIPPON STEEL & SUMITOMO METAL CORPORATION, Tokyo (JP)

(72) Inventors: Yoshiaki Hirota, Tokyo (JP); Masato Taira, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 455 days.

(21) Appl. No.: 15/508,057

(22) PCT Filed: Sep. 4, 2015

(86) PCT No.: PCT/JP2015/075266
§ 371 (c)(1),
(2) Date: Mar. 1, 2017

(87) PCT Pub. No.: WO2016/035893
PCT Pub. Date: Mar. 10, 2016

(65) Prior Publication Data

US 2017/0290102 A1 Oct. 5, 2017

(30) Foreign Application Priority Data

Sep. 5, 2014 (JP) ..... 2014-181710

(51) Int. Cl.
*H05B 6/10* (2006.01)
*C21D 9/60* (2006.01)
(Continued)

(52) U.S. Cl.
CPC ..... *H05B 6/10* (2013.01); *C21D 1/00* (2013.01); *C21D 1/42* (2013.01); *C21D 9/60* (2013.01);
(Continued)

(58) Field of Classification Search
CPC ... H05B 6/10; H05B 6/36; H05B 6/40; H05B 6/44; C21D 1/00; C21D 1/42; C21D 9/60; F27B 9/36; F27D 11/06
(Continued)

(56) References Cited

U.S. PATENT DOCUMENTS 2,722,589 A * 11/1955 Marquardt ..... H05B 6/104 219/645
3,031,555 A * 4/1962 Ross ..... H05B 6/40 219/672
(Continued)

FOREIGN PATENT DOCUMENTS

CN 101617562 A 12/2009
CN 101707908 B 6/2012
(Continued)

OTHER PUBLICATIONS

Extended European Search Report dated Mar. 15, 2018 in Patent Application No. 15838715.9.
(Continued)

*Primary Examiner* — Jimmy Chou
(74) *Attorney, Agent, or Firm* — Birch, Stewart, Kolasch & Birch, LLP

(57) ABSTRACT

An induction heating device for a metal strip includes a first induction coil member and a second induction coil member provided in parallel with a metal strip across the metal strip that travels in a longitudinal direction, provided to protrude from the metal strip, and provided so as not to overlap each other in the traveling direction of the metal strip, and a magnetic core member provided between the first induction coil member and the second induction coil member, and provided to cover a large area of an end portion in the sheet width direction of the metal strip on the side of each of the first induction coil member and the second induction coil member, and cover a small area of the end at a center portion
(Continued)

between the first induction coil member and the second induction coil member.

6 Claims, 13 Drawing Sheets

(51) Int. Cl.

| | |
|---|---|
| ***C21D 1/42*** | (2006.01) |
| ***F27B 9/36*** | (2006.01) |
| ***C21D 1/00*** | (2006.01) |
| ***H05B 6/36*** | (2006.01) |
| ***F27D 11/06*** | (2006.01) |
| ***H05B 6/40*** | (2006.01) |
| ***H05B 6/44*** | (2006.01) |

(52) U.S. Cl.
CPC ..... *F27B 9/36* (2013.01); *F27D 11/06* (2013.01); *H05B 6/36* (2013.01); *H05B 6/40* (2013.01); *H05B 6/44* (2013.01)

(58) Field of Classification Search
USPC ..... 219/645, 647, 646, 637, 624, 673, 622, 219/600, 672, 671
See application file for complete search history.

(56) References Cited

U.S. PATENT DOCUMENTS

| | | | | | |
|---|---|---|---|---|---|
| 4,751,360 | A * | 6/1988 | Ross | C21D 9/60 | 219/645 |
| 4,775,772 | A * | 10/1988 | Chaboseau | C21D 9/60 | 219/645 |
| 4,795,872 | A * | 1/1989 | Hagisawa | C21D 9/60 | 219/645 |
| 5,278,381 | A * | 1/1994 | Rilly | H05B 6/1209 | 156/272.2 |
| 5,317,121 | A * | 5/1994 | Katayama | H05B 6/36 | 219/672 |
| 5,397,877 | A * | 3/1995 | Couffet | F27B 9/067 | 219/645 |
| 5,837,976 | A * | 11/1998 | Loveless | H05B 6/04 | 219/645 |
| 6,198,083 | B1 * | 3/2001 | Pierman | C21D 9/525 | 148/568 |
| 6,864,419 | B2 * | 3/2005 | Lovens | H05K 9/0071 | 174/350 |
| 6,963,056 | B1 * | 11/2005 | Peysakhovich | H05B 6/104 | 219/645 |
| 8,502,122 | B2 * | 8/2013 | Hirota | C21D 1/10 | 219/645 |
| 8,592,735 | B2 * | 11/2013 | Hirota | H05B 6/365 | 219/645 |
| 9,578,693 | B2 * | 2/2017 | Umetsu | C21D 1/42 | |
| 9,888,529 | B2 * | 2/2018 | Hirota | H05B 6/104 | |
| 10,292,210 | B2 * | 5/2019 | Umetsu | C21D 9/60 | |
| 2002/0011486 | A1 * | 1/2002 | Anderhuber | H05B 6/104 | 219/645 |
| 2002/0148830 | A1 * | 10/2002 | Ross | H05B 6/104 | 219/670 |
| 2003/0222079 | A1 * | 12/2003 | Lawton | H05B 6/107 | 219/619 |
| 2006/0196870 | A1 * | 9/2006 | Nikanorov | C21D 1/42 | 219/645 |
| 2007/0012663 | A1 * | 1/2007 | Hosokawa | H01J 37/3408 | 219/121.43 |
| 2007/0131673 | A1 * | 6/2007 | Rapoport | G01R 33/3806 | 219/497 |
| 2007/0194010 | A1 * | 8/2007 | Lovens | C21D 1/42 | 219/645 |
| 2007/0235445 | A1 * | 10/2007 | Wilgen | H05B 6/101 | 219/635 |
| 2008/0264932 | A1 * | 10/2008 | Hirota | H05B 6/365 | 219/672 |
| 2009/0057301 | A1 * | 3/2009 | Lovens | H05B 6/104 | 219/645 |
| 2009/0255924 | A1 * | 10/2009 | Lovens | H05B 6/104 | 219/645 |
| 2010/0072192 | A1 | 3/2010 | Hirota | | |
| 2010/0108665 | A1 | 5/2010 | Hirota | | |
| 2010/0155390 | A1 * | 6/2010 | Hirota | H05B 6/362 | 219/645 |
| 2010/0187223 | A1 * | 7/2010 | Peysakhovich | H05B 6/40 | 219/646 |
| 2011/0036831 | A1 * | 2/2011 | Warner | C21D 1/42 | 219/660 |
| 2013/0015178 | A1 * | 1/2013 | Lin | B29C 45/73 | 219/660 |
| 2014/0008356 | A1 * | 1/2014 | Uchida | H05B 6/06 | 219/672 |
| 2017/0290102 | A1 * | 10/2017 | Hirota | C21D 9/60 | |

FOREIGN PATENT DOCUMENTS

| | | | | |
|---|---|---|---|---|
| EP | 2 112 863 | A1 | 10/2009 | |
| JP | 59-205183 | A | 11/1984 | |
| JP | 62-281291 | A | 12/1987 | |
| JP | 63-119188 | A | 5/1988 | |
| JP | 10-111981 | A | 4/1998 | |
| JP | 2002-008838 | A | 1/2002 | |
| JP | 2004-296368 | A | 10/2004 | |
| JP | 2006-294396 | A | 10/2006 | |
| JP | 2007-95651 | A | 4/2007 | |
| JP | 2008-186589 | A | 8/2008 | |
| JP | 2008-204648 | A | 9/2008 | |
| JP | 2008-288200 | A | 11/2008 | |
| JP | 2009-259588 | A | 11/2009 | |
| JP | 2009259588 | * | 11/2009 | B21B 45/004 |
| JP | 2010-245029 | A | 10/2010 | |
| RU | 2431946 | C2 | 10/2011 | |

OTHER PUBLICATIONS

International Search Report for PCT/JP2015/075266 (PCT/ISA/210) dated Nov. 24, 2015.

Written Opinion of the International Searching Authority for PCT/JP2015/075266 (PCT/ISA/237) dated Nov. 24, 2015.

Chinese Office Action dated Apr. 19, 2019, for corresponding Chinese Patent Application No. 201580046992.4, with partial English translation.

Russian Office Action and Search Report, dated May 30, 2018, for corresponding Russian Application No. 2017107070, with an English Translation.

* cited by examiner

INDUCTION HEATING DEVICE FOR METAL STRIP

TECHNICAL FIELD

The present description relates to an induction heating device for a metal strip.

BACKGROUND ART

Heating of a metal strip in a heat-treating furnace has been performed mainly by indirect heating using a radiant tube. The indirect heating restricts productivity because, in addition to large thermal inertia, valid heat input into a metal strip becomes difficult as the difference between the temperature of metal strip and furnace temperature becomes small. Furthermore, in the indirect heating using a radiant tube, for example, for a steel sheet such as a carbon steel, it is difficult to perform rapid heating near the transformation point at which endothermic reaction occurs, and to perform high-temperature annealing because of restriction by heat resistance of the radiant tube, restricting choice of degrees of freedom of heat treatment conditions for metal strip.

In contrast, induction heating in which a metal strip is heated with high-frequency current is capable of freely controlling heating speed and heating temperature, so that the induction heating has large degrees of freedom at the points of heat treatment operation and development of metal strip products and is a heating method that has been paid attention recently.

The induction heating is largely categorized into two methods. One is an LF (longitudinal flux heating) system for heating a metal strip by flowing high-frequency current in an induction coil surrounding the circumference of a metal strip to make magnetic flux pass through a cross section in the longitudinal direction (traveling direction) of the metal strip to generate induction current circulating in a cross section in the width direction of the metal strip perpendicular to the magnetic flux.

The other method is a TF (transverse flux heating) system for heating a metal strip by arranging inductors (sufficient magnetic bodies) around which respective primary coils are wound to sandwich the metal strip and flowing currents in the primary coils to make the magnetic fluxes generated by the currents pass through sheet surfaces of the metal strip via the inductors to generate induction currents in the sheet surfaces of the metal strip.

In the induction heating by the LF system for making induction current circulate in a sheet cross section, on the basis of the relationship between current penetration depth $\delta$ and current frequency $f(\delta(\text{mm})=5.03\times10^5\sqrt{(\rho/\mu r\cdot f)}$, $\rho(\Omega\text{m})$: specific resistance, $\mu r$: relative magnetic permeability, f: frequency (Hz)), when the current penetration depth of the induction current generated on the front and back of the metal strip is deeper than the thickness of the steel sheet, the generated currents interfere with each other, generating no induction current in a cross section of the metal strip.

For example, in the case of a non-magnetic metal strip or a steel sheet that loses magnetic properties over its Curie temperature, current penetration depth $\delta$ becomes deep, generating no induction current when the sheet thickness of the metal strip is thin. Furthermore, even in the case of magnetic material, no induction current generates in a cross section of steel sheet in the LF system when the sheet thickness is too thin as compared with penetration depth.

On the other hand, in the induction heating by the TF system, magnetic flux passes through a sheet surface of the metal strip, enabling the metal strip to be heated regardless of sheet thickness and difference of magnetism and non-magnetism, but heating efficiency is lowered or heating is entirely impossible in some cases when opposite inductors are not adjacent. Furthermore, overheating readily occurs at ends of the metal strip disadvantageously (for example, see Japanese Patent Application Laid-Open (JP-A) No. S63-119188).

Furthermore, when a magnetic metal strip is not located at the center of opposing inductors, the magnetic metal strip may be pulled to one of the inductors to make magnetic flux be concentrated regionally to increase temperature variation of the metal strip. Furthermore, in the induction heating by normal TF system, the inductor is difficult to be easily changed in its shape, disadvantageously making it difficult to cope with change in sheet width of the metal strip.

For that reason, for example, an electromagnetic induction heating device has been disclosed in Japanese Patent Application Laid-Open (JP-A) No. S59-205183 that includes a magnetic pole segments arranged in parallel with a sheet width direction of a sheet to oppose the sheet and independently movable in the thick direction of the sheet and a movable masking shield made of a non-magnetic metal capable of appearing and retreating in the sheet width direction of the sheet for adjusting magnetic field generated by the magnetic pole segments.

The electromagnetic induction heating device of JP-A No. S59-205183 is capable of adjusting magnetic flux in response to change in sheet width of the sheet, but is difficult to rapidly adjust magnetic flux in sheet width direction when sheet width of the sheet is largely changed.

Japanese Patent Application Laid-Open (JP-A) No. 2002-008838 discloses an induction heating device having a plurality of independent magnetic bars and equipped with a magnetic circuit with a variable width adaptable to the width of a metal strip. However, in the induction heating device of JP-A No. JP 2002-008838, an example is illustrated in which magnetic cores movable in a width direction is provided near respective induction coils placed apart from front and back sides.

SUMMARY OF INVENTION

Embodiments of the description aims mainly to provide an induction heating device for a metal strip capable of controlling temperature distribution at ends in the sheet width direction of a metal strip by adjusting current density of and heating period by induction currents flowing at the ends in the sheet width direction of the metal strip.

According to an aspect of the present description, there is provided an induction heating device for a metal strip including: an induction coil including a first induction coil member and a second induction coil member that are provided in parallel with a metal strip across the metal strip that travels in a longitudinal direction thereof, that are provided such that both ends of each of the first induction coil member and the second induction coil member protrude from the traveling metal strip in a sheet width direction of the traveling metal strip, and that are arranged such that vertical projection images thereof onto the traveling metal strip do not overlap each other in a traveling direction in which the metal strip travels, a first electrical connector for electrically connecting one of both ends of the first induction coil member and one of both ends of the second induction coil member, and a second electrical connector for electrically connecting another one of the both ends of the first induction coil member and another one of the both ends of the second induction coil member; a first magnetic core including a first magnetic core member provided between the first induction coil member and the second induction coil member in the traveling direction, the first magnetic core member being provided on one of surface sides of the traveling metal strip and covering a large area of one end portion in the sheet width direction of the traveling metal strip, the large area being on a side of each of the first induction coil member and the second induction coil member, and covering a small area of the one end portion at a center portion between the first induction coil member and the second induction coil member, and a second magnetic core member provided between the first induction coil member and the second induction coil member in the traveling direction, the second magnetic core member being provided on another one of the surface sides opposite from the one of the surface sides of the traveling metal strip and covering a large area of the one end portion in the sheet width direction of the traveling metal strip, the large area being on the side of each of the first induction coil member and the second induction coil member, and covering a small area of the one end portion at the center portion between the first induction coil member and the second induction coil member; and a second magnetic core including a third magnetic core member provided between the first induction coil member and the second induction coil member in the traveling direction, the third magnetic core member being provided on the one of the surface sides of the traveling metal strip and covering a large area of another end portion opposite from the one end portion in the sheet width direction of the traveling metal strip, the large area being on the side of each of the first induction coil member and the second induction coil member, and covering a small area of the another end portion at the center portion between the first induction coil member and the second induction coil member, and a fourth magnetic core member provided between the first induction coil member and the second induction coil member in the traveling direction, the fourth magnetic core member being provided on another one of the surface sides of the traveling metal strip and covering a large area of the another end portion in the sheet width direction of the traveling metal strip, the large area being on the side of each of the first induction coil member and the second induction coil member, and covering a small area of the another end portion at the center portion between the first induction coil member and the second induction coil member.

DESCRIPTION OF EMBODIMENTS

In an induction heating device, a magnetic core arranged on the side of an end in the sheet width direction of a metal strip that travels in a longitudinal direction to cover the end pushes, at the end of the metal strip, the induction current generated by induction coils arranged on the front and the back sides of the metal strip outside the magnetic core (center direction of the metal strip) to suppress the induction current from being concentrated at the end of the metal strip.

However, it is difficult to adequately control current density of and heating period by induction current flowing at the end in the sheet width direction of the metal strip to appropriately control temperature distribution at the end in the sheet width direction of the metal strip by only partially arranging the magnetic core at the end in the sheet width direction of the metal strip.

The present inventors have intensively studied about a method of adequately controlling current density of and heating period by induction current flowing at the end in the sheet width direction of the metal strip to appropriately control temperature distribution at the end in the sheet width direction of the metal strip. As a result, the inventors have found that arrangement of a magnetic core having a predetermined profile on the side of an end in the sheet width direction at the end in the sheet width direction of the metal strip at which induction current flows instead of partially arranging a magnetic core at the end in the sheet width direction of the metal strip makes it possible to adequately control current density of and heating period by induction current flowing at the end in the sheet width direction of the metal strip and to appropriately control temperature distribution at the end in the sheet width direction of the metal strip. It is preferable that the predetermined profile is a shape covering a large area of the end in the sheet width direction of the metal strip on each of both end sides in the traveling direction of the metal strip and near corresponding one of induction coils, and covering a small area of the end at a center portion as compared with the both end sides.

Furthermore, the inventors have found that the magnetic core may be divided into a plurality of members in a traveling direction of a metal strip, and that temperature distribution of an end in the sheet width direction of a metal strip can be freely controlled as long as including a moving mechanism for moving each of the divided plurality of members in the sheet width direction of the metal strip.

Embodiments of the description are made on the basis of the above knowledge. Hereinafter, induction heating devices of the embodiments of the description will be described with reference to the drawings.

First, the induction heating device that is the premise of the embodiments of the description and a mode of induction current generated in a metal strip by the induction heating device will be described.

Figure 1:
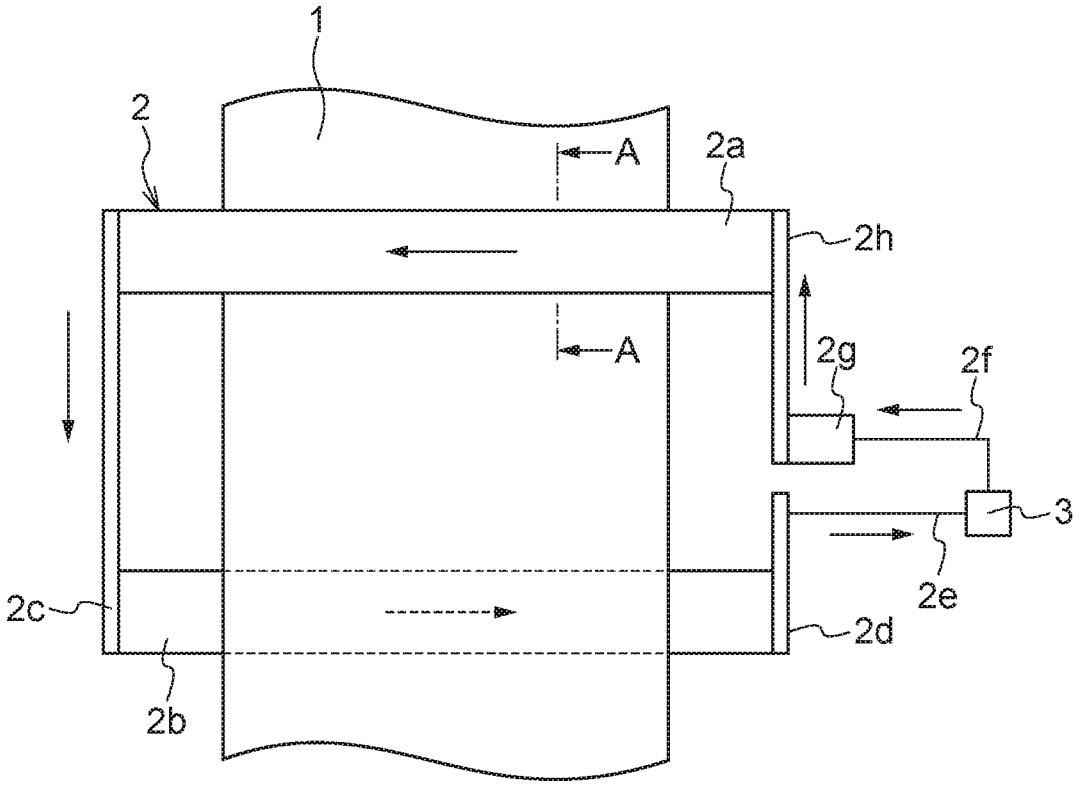
FIG. 1 is a diagram illustrating a mode of an induction heating device in which an induction coil member on a front surface side of a metal strip and an induction coil member on a back surface side of the metal strip are arranged such that a vertical projection image of the induction coil member on the front surface side of the metal strip and a vertical projection image of the induction coil member on the back surface side of the metal strip do not overlap in a longitudinal direction of the metal strip.

FIG. 1 illustrates a mode of the induction heating device in which an induction coil member 2*a* on the front surface side of the metal strip 1 and an induction coil member 2*b* on the back surface side of the metal strip 1 are arranged such that a vertical projection image of the induction coil member 2*a* on the front surface side of the metal strip 1 onto the metal strip 1 and a vertical projection image of the induction coil member 2*b* on the back surface side of the metal strip 1 onto the metal strip 1 are not overlapped in a longitudinal direction (traveling direction) of the metal strip 1.

The induction coil member 2*a* and the induction coil member 2*b* are arranged in parallel with the metal strip 1. Both ends of the induction coil member 2*a* and both ends of the induction coil member 2*b* are protruded from the metal strip 1 in the sheet width direction of the metal strip 1.

In the induction heating device illustrated in FIG. 1, an end of the induction coil member 2*a* on the front surface side of the metal strip 1 passing through the inside of an induction coil 2 and an end of the induction coil member 2*b* on the back surface side of the metal strip 1 are coupled with a conductor 2*c*, and the other end of the induction coil member 2*b* is connected to a power source 3 via a conductor 2*d* and a conductive wire 2*e*, and the other end of the induction coil member 2*a* is connected to the power source 3 via a conductor 2*h*, a coupler 2*g*, and a conductive wire 2*f*. Current flows in the directions of the arrows in the drawing. The conductor 2*c* is an example of the electrical connector, and the conductor 2*d*, the conductive wire 2*e*, the conductive wire 2*f*, and the conductor 2*h* are also examples of the electrical connector. The induction coil 2 includes the induction coil member 2*a*, the induction coil member 2*b*, the conductor 2*c*, the conductor 2*d*, the conductive wire 2*e*, the conductive wire 2*f*, and the conductor 2*h*.

The induction coil member 2*a* and the induction coil member 2*b* are arranged such that the vertical projection image that is the vertical projection of the induction coil member 2*a* onto the metal strip 1 and the vertical projection image that is the vertical projection of the induction coil member 2*b* onto the metal strip 1 are not overlapped in the longitudinal direction (traveling direction) of the metal strip 1.

In the case of the above LF method, induction currents having the same magnitude flow on the respective front and back surfaces of the metal strip in reverse directions, so that when current penetration depth δ is deep, the induction currents interfere to each other, making no induction current flow. However, in the case of FIG. 1, the induction coil members 2*a* and 2*b* are arranged such that the vertical projection images that are vertical projections thereof onto the metal strip 1 are not overlapped in the longitudinal direction (traveling direction) of the metal strip 1, so that each of the induction current flowing in the metal strip 1 just below the induction coil member 2*a* and the induction current flowing in the metal strip 1 just below the induction coil member 2*b* becomes a current that flows in only one direction, allowing the currents to flow without interfering to each other even when current penetration depth δ is deep.

Figure 2A:
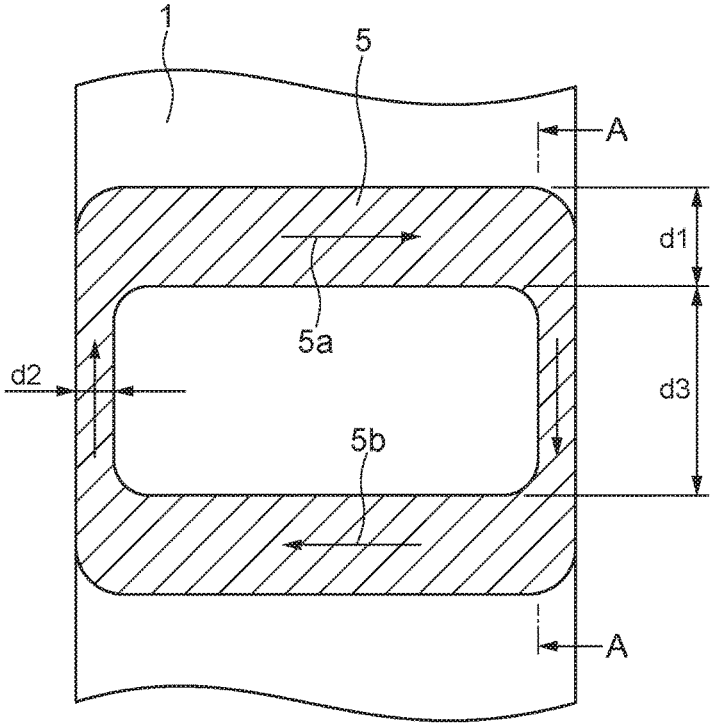
FIG. 2A is a diagram illustrating a plane aspect of an induction current generated in the whole metal strip.
Figure 2B:
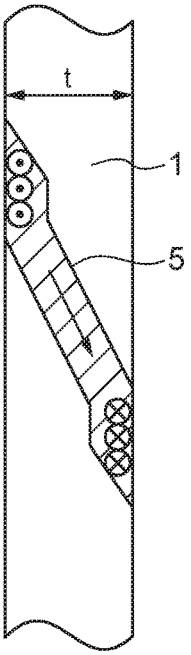
FIG. 2B is A-A cross section of FIG. 2A, and is a diagram illustrating a mode of the induction current at the end cross section of the metal strip of the induction current generated in the whole metal strip.

FIGS. 2A and 2B illustrate a mode of an induction current 5 generated in the whole metal strip 1. FIG. 2A illustrates a planer mode of the induction current, and FIG. 2B illustrates a mode of the induction current 5 at an end cross section (A-A cross section of FIG. 2A) of the metal strip 1.

In the metal strip 1 just below the induction coil members 2*a*, 2*b* (not shown), an annular induction current 5 (5*a*, 5*b*) generates that flows in the directions of the arrows (inverse directions of the current flowing in the induction coil members 2*a*, 2*b*) as illustrated in FIG. 2A. The induction coil member 2*a* is arranged on the front surface side of the metal strip 1, and the induction coil member 2*b* is arranged on the back surface side of the metal strip 1, so that the induction current 5 flows to obliquely cross the end cross section of the metal strip 1 as illustrated in FIG. 2B. Even when the metal strip 1 is non-magnetic material, the induction currents 5 generates and circulates, enabling the metal strip 1 to be heated. FIG. 2B illustrates a state of current flow when the sheet thickness of the metal strip 1 is thick, but when the sheet thickness of the metal strip 1 is thin, current does not obliquely cross and flows in the whole sheet thickness of the metal strip 1.

However, overheating readily occurs at the ends in the sheet width direction of the metal strip 1, because, for example, (a) the induction current flowing at the ends in the sheet width direction of the metal strip 1 tries to make the reactance between with the primary current flowing in the conductor 2*c* (see FIG. 1) coupling the induction coil member 2*a* on the front surface side with the induction coil member 2*b* on the back surface side of the metal strip 1 (see FIG. 1), or flowing in the conductor 2*d*, the conductive wire 2*e*, the conductive wire 2*f*, and the conductor 2*h* (see FIG. 1) coupling the induction coil on the front surface side and the induction coil on the back surface side of the metal strip with the power source small to be unfortunately shifted to the ends in the sheet width direction of the metal strip 1, unfortunately narrowing the width d2 of the current path, (b)

the magnetic flux generated by the primary current flowing in the conductor 2*c*, the conductor 2*d*, the conductive wire 2*e*, the conductive wire 2*f*, and the conductor 2*h* concentrically passing through the ends in the sheet width direction of the adjacent metal strip 1, and (c) at the ends in the sheet width direction of the metal strip 1, as compared with the center of the metal strip 1, heating is performed for a long period by the distance d3 in the longitudinal direction (traveling direction) of the metal strip 1 (heating distance for the center is d1×2, heating distance for the ends in the sheet width direction is d1×2+d3).

Furthermore, when the induction coil 2 is a pair of coil members, magnetic flux spreads outside the induction coil 2, which lowers the current density of the induction current 5 at the center of the metal strip 1, making it difficult to increase the temperature at the center to make the thermal difference between the center and the ends in the sheet width direction of the metal strip 1 readily increase.

So, in the induction heating device of the embodiments of the description, to control the induction current 5 flowing at the ends in the sheet width direction of the metal strip 1 across the whole width of the ends where the induction current 5 flows and to freely control the temperature distribution in the sheet width direction of the metal strip 1, a plurality of magnetic cores capable of covering the ends in the sheet width direction of the metal strip 1 and the metal strip 1 beyond the ends is arranged across the whole width between the vertical projection image of the induction coil member 2*a* on the front surface side of the metal strip 1 onto the metal strip 1 and the vertical projection image of the induction coil member 2*b* on the back surface side of the metal strip 1 onto the metal strip 1 so as to be movable forwardly and backwardly in the sheet width direction of the metal strip 1.

The induction coil members 2*a*, 2*b* may be one conductor or may be a plurality of conductors. Furthermore, a magnetic core for a back surface may be mounted at the back surface of the induction coil members 2*a*, 2*b* to enforce magnetic flux.

Figure 3A:
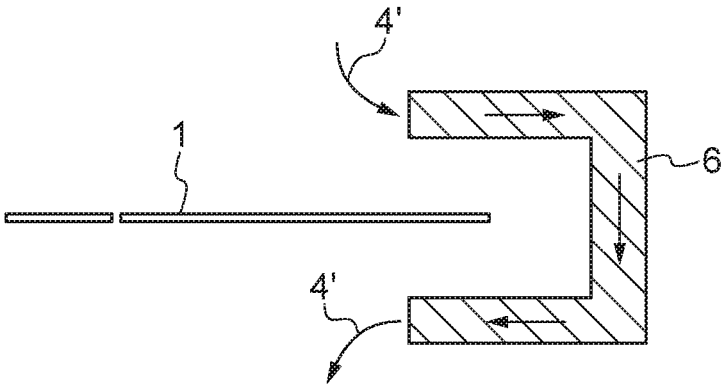
FIG. 3A is a diagram illustrating a cross sectional structure of a magnetic core for comparison.
Figure 3B:
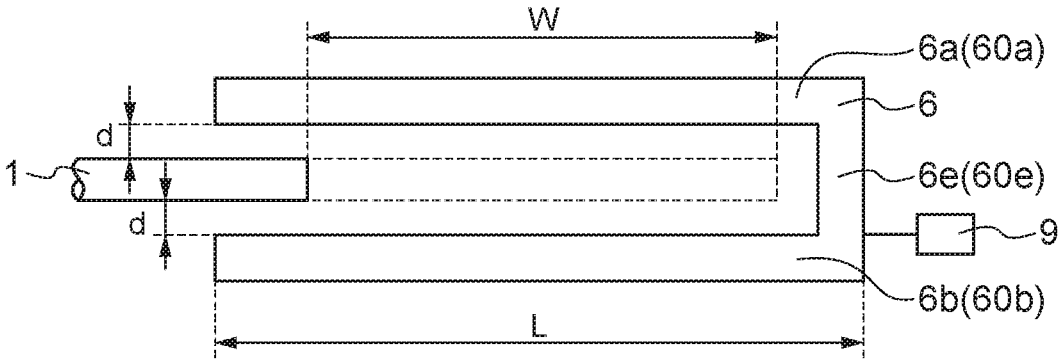
FIG. 3B is a diagram schematically illustrating a cross sectional structure of a magnetic core used in embodiments of the description.
Figure 3C:
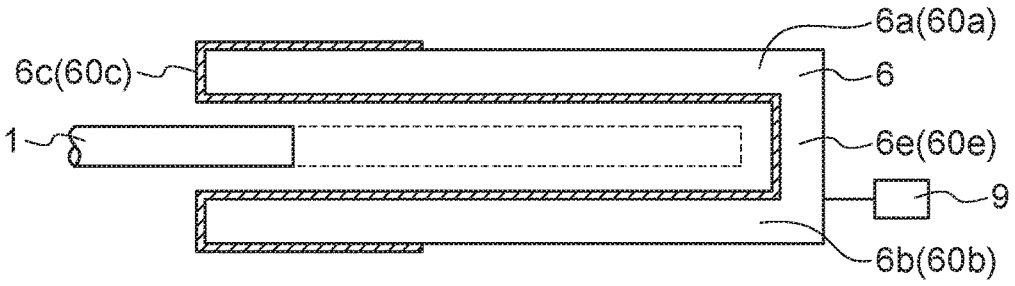
FIG. 3C is a diagram schematically illustrating a cross sectional structure of another magnetic core used in the embodiments of the description.
Figure 3D:
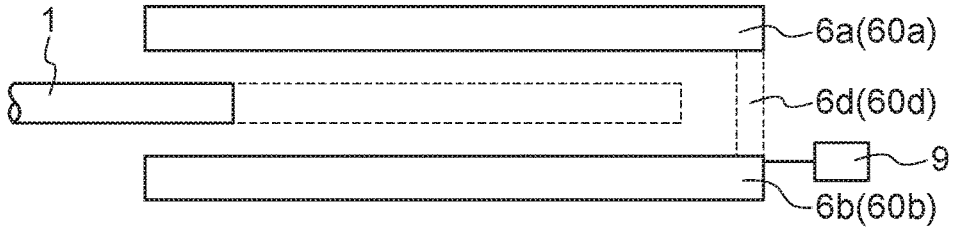
FIG. 3D is a diagram schematically illustrating a cross sectional structure of still another magnetic core used in the embodiments of the description.

FIGS. 3A to 3D each illustrate a cross sectional structure of a magnetic core 6. FIG. 3A illustrates a cross sectional structure of the magnetic core 6 for comparison, FIG. 3B illustrates a cross sectional structure of the magnetic core 6 used in the embodiments, and FIG. 3C illustrates a cross sectional structure of another magnetic core 6 used in the embodiments. FIG. 3D schematically illustrates a cross sectional structure of a still another magnetic core 6 used in the embodiments.

The size of the magnetic core 6 is not limited to a specific range and may be appropriately set on the basis of the distance between the induction coil members 2*a*, 2*b* on the front surface side and back surface side of the metal strip 1, the sheet width of the metal strip 1, and the number of the magnetic cores 6 to be arranged.

Although the magnetic core 6 is formed of a ferromagnetic substance, the ferromagnetic substance is not limited to a ferromagnetic substance of a specific material. The ferromagnetic substance includes, for example, ferrite, laminated magnetic steel sheet, and amorphous alloy, and may be appropriately selected depending on heating capability, frequency, etc. applied to the induction heating device.

As illustrated in FIG. 3A, the magnetic core 6 for comparison covering the end in the sheet width direction of the metal strip 1 absorbs magnetic flux 4' excited by the induction coil (not shown) (see the arrows passing through the magnetic core 6') to prevent magnetic flux concentration to the end in the sheet width direction of the metal strip 1, and suppresses excessive temperature increase at the end in the sheet width direction of the metal strip 1. However, when the magnetic core 6' is partially and individually arranged, the suppress effect of end current is limited, so that the effect is small.

In the magnetic core 6 used in the embodiments illustrated in FIG. 3B, the distance d with the metal strip 1 is set narrow to suppress passage of current effectively at the end in the sheet width direction of the metal strip 1, the length L of the magnetic core in the sheet width direction of the metal strip 1 is set long such that the magnetic core 6 covers the metal strip beyond the end in the sheet width direction of the metal strip 1 to be able to appropriately control distribution of the induction current, and the depth of the portion covering the metal strip 1 is set deep such that the magnetic core 6 is capable of immediately cope with change W in the sheet width of the metal strip 1.

The magnetic core 6 includes a magnetic core member 6*a* on the front surface side of the metal strip 1, a magnetic core member 6*b* on the back surface side thereof, and a magnetic core member 6*e* for coupling ends (right side ends in the drawings) of the magnetic core member 6*a* and the magnetic core member 6*b*, which are on the side opposite from the portions of the magnetic core member 6*a* and the magnetic core member 6*b* covering the metal strip 1.

A surface portion readily accepting heat of the magnetic core 6 may be covered with a non-magnetic heat insulating material 6*c* as illustrated in FIG. 3C to suppress temperature increase due to radiation heat from the heated metal strip 1 to stably use the magnetic core 6. Note that when temperature increase of the magnetic core 6 cannot be suppressed only by coating of the heat insulating material 6*c*, the magnetic core 6 may be cooled by, for example, attaching a water-cooling plate (not shown) to the magnetic core 6 or by providing a gas cooling device (not shown) near the magnetic core 6.

The induction heating device of the embodiments is provided with a moving member 9 for moving the magnetic core 6 illustrated in FIG. 3B or 3C forward and backward in the sheet width direction of the metal strip 1. Moving the magnetic core 6 in the sheet width direction of the metal strip 1 by the moving member 9 is performed by, for example, moving a carriage for holding the magnetic core with a driving device such as an electric cylinder, an air cylinder, or a motor in an orbit. However, the magnetic core 6 may only to be moved quickly and smoothly in the sheet width direction of the metal strip 1, and the moving member for the magnetic core 6 is not specifically specified as long as the conditions are satisfied.

FIG. 3D schematically illustrates a cross sectional structure of a still another magnetic core 6 used in the embodiments. In the magnetic core 6 illustrated in FIG. 3D, an end (a right end in the drawing) of the magnetic core 6 are not coupled by a magnetic body. The magnetic core 6 includes a magnetic core member 6*a* on the front surface side and a magnetic core member 6*b* on the back surface side of the metal strip 1. To keep the distance between the magnetic core member 6*a* and the magnetic core member 6*b*, the ends on the side opposite to the portions covering the metal strip 1 (in the drawing, right side ends) are coupled by a coupling member 6*d* that is non-magnetic and has heat resistance.

In the magnetic core 6 illustrated in FIG. 3D, although the magnetic core member 6*a* and the magnetic core member 6*b* are arranged on the front surface side and the back surface side of the metal strip 1, respectively, and the magnetic core member 6*a* and the magnetic core member 6*b* are coupled by the coupling member 6*d*, the magnetic core 6 illustrated in FIG. 3D has the current suppressing effect similar to that by the magnetic core 6 illustrated in FIG. 3B in which the magnetic core member 6*a* and the magnetic core member 6*b* are coupled by the magnetic core member 6*e*. The magnetic core 6 is capable of immediately following change in sheet width by forward/backward movement in the sheet width direction of the metal strip 1 by the moving member 9 even when the sheet width of the metal strip 1 is changed, and makes it possible to immediately follow positional deviation even when the metal strip 1 continuously snakes and the position of the end in the sheet width direction is largely deviated.

Figure 4:
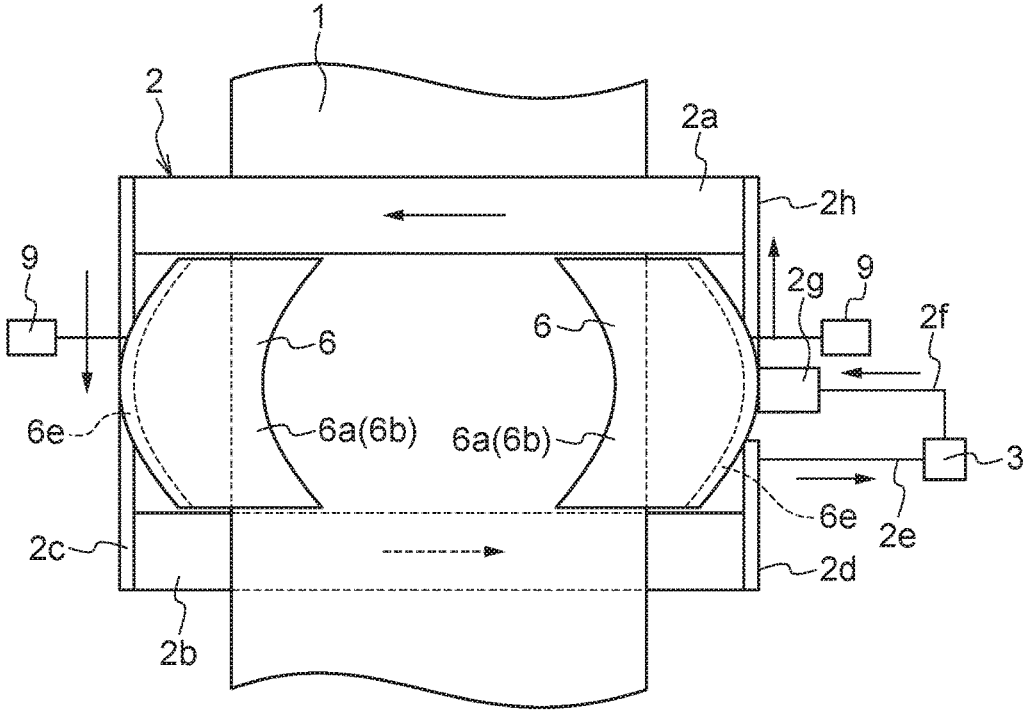
FIG. 4 is a diagram illustrating an arrangement mode of the magnetic core in the embodiments of the description, and is a diagram illustrating a case where the magnetic core is not divided into a plurality of magnetic cores and the induction coil members are arranged in parallel with a sheet width direction of the metal strip.

FIG. 4 illustrates an arrangement mode of the magnetic cores 6 in the embodiments. The induction coil members 2*a*, 2*b* are arranged in parallel with the sheet width direction of the metal strip 1. The magnetic cores 6 capable of covering the respective ends in the sheet width direction of the metal strip 1 and the metal strip 1 beyond the ends are arranged on the both sides in the sheet width direction of the metal strip 1. The magnetic cores 6 are arranged across the whole width between the vertical projection image of the induction coil member 2*a* on the front surface side of the metal strip 1 onto the metal strip 1 and the vertical projection image of the induction coil member 2*b* on the back surface side of the metal strip 1 onto the metal strip 1.

As illustrated in FIG. 3B, the magnetic core 6 includes the magnetic core member 6*a* on the front surface side and the magnetic core member 6*b* on the back surface side of the metal strip 1, and the magnetic core member 6*e* coupling the ends (in the drawing, right side ends) on the side opposite from the portions covering the metal strip 1 of the magnetic core member 6*a* and the magnetic core member 6*b*. Note that the non-magnetic coupling member 6*d* may be provided instead of the magnetic core member 6*e* as illustrated in FIG. 3D. Alternatively, as illustrated in FIG. 3C, the magnetic core 6 may be covered with the non-magnetic heat insulating material 6*c*.

The magnetic core member 6*a* and the magnetic core member 6*b* cover a large area of the end in the sheet width direction of the metal strip 1 on the side of each of the induction coil member 2*a* and the induction coil member 2*b*, and cover a small area of the ends at the center portion between the induction coil member 2*a* and the induction coil member 2*b*. The side of each of the magnetic core member 6*a* and the magnetic core member 6*b* covering the end in the sheet width direction of the metal strip 1 is bent.

The magnetic core member 6*a* and the magnetic core member 6*b* are movable forwardly and backwardly in the sheet width direction of the metal strip 1 by the moving member 9 to follow change in the sheet width, and capable of following positional deviation due to snaking or the like of the metal strip 1.

Figure 5A:
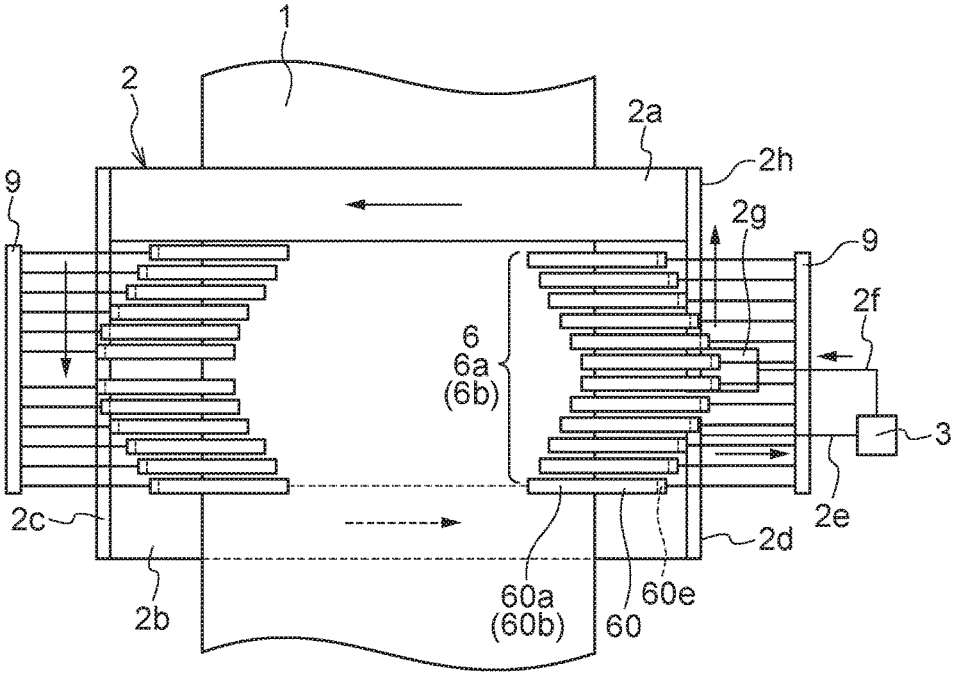
FIG. 5A is a diagram illustrating an arrangement mode of the magnetic core in the embodiments of the description, and is a diagram illustrating a case where the magnetic core is divided into a plurality of magnetic cores and the induction coil members are arranged in parallel with the sheet width direction of the metal strip.
Figure 5B:
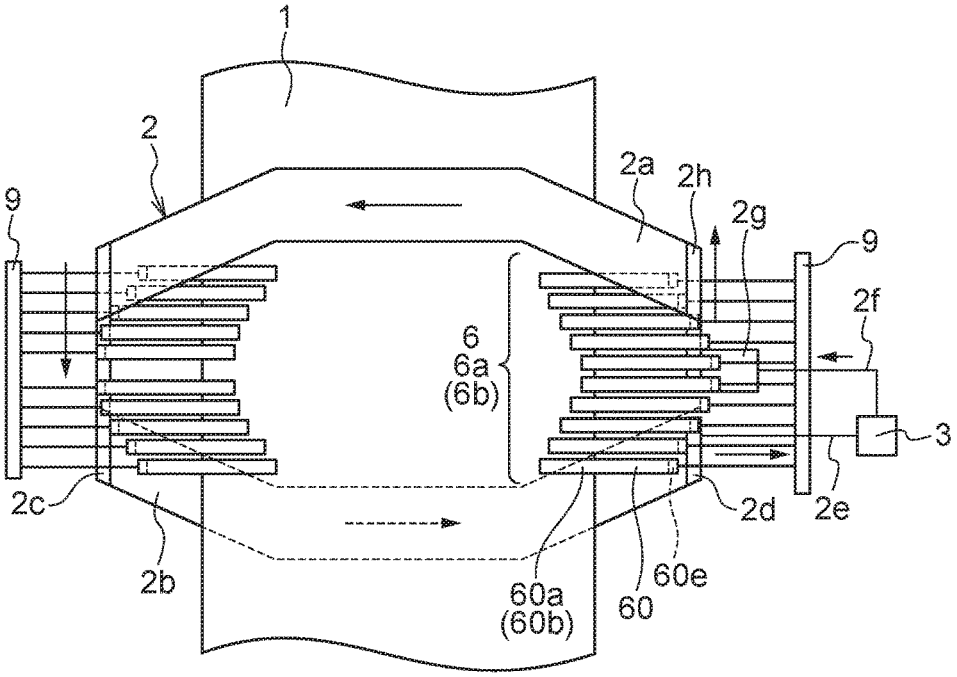
FIG. 5B is a diagram illustrating an arrangement mode of the magnetic core in the embodiments of the description, and is a diagram illustrating a case where the magnetic core is divided into a plurality of magnetic cores and the induction coil members are arranged so as to incline toward ends in the sheet width direction.

FIGS. 5A and 5B each illustrate an arrangement mode of the magnetic cores 6 of the embodiment. FIG. 5A illustrates a case where the induction coil members 2*a*, 2*b* are arranged in parallel with the sheet width direction of the metal strip 1, and FIG. 5B illustrates a case where the induction coil members 2*a*, 2*b* are arranged to incline toward the ends in the sheet width direction of the metal strip 1. The case is illustrated in which the induction coil member 2*a* is arranged to incline on the side of the induction coil member 2*b* toward the ends in the sheet width direction of the metal strip 1, and the induction coil member 2*b* is arranged to incline on the side of the induction coil member 2*a* toward the ends in the sheet width direction of the metal strip 1.

As illustrated in FIGS. 5A, 5B, the magnetic cores 6 capable of covering the ends in the sheet width direction of the metal strip 1 and the metal strip 1 beyond the ends in the sheet width direction are arranged on the respective both sides in the sheet width direction of the metal strip 1. The magnetic cores 6 are arranged across the whole width between the vertical projection image of the induction coil member 2*a* on the front surface side of the metal strip 1 onto the metal strip 1 and the vertical projection image of the induction coil member 2*b* on the back surface side of the metal strip 1 onto the metal strip 1.

The magnetic core 6 is divided into a plurality of magnetic cores 60 in the longitudinal direction (traveling direction) of the metal strip 1. The magnetic core member 6*a* on the front surface side of the metal strip 1 is divided into a plurality of magnetic core members 60*a*. The magnetic core member 6*b* on the back surface side of the metal strip 1 is divided into a plurality of magnetic core members 60*b*. The magnetic core member 6*e* coupling the ends on the side opposite from the portions covering the metal strip 1 (in the drawing, right side ends) of the magnetic core member 6*a* and the magnetic core member 6*b* is divided into a plurality of magnetic core members 60*e*. The number of the plurality of magnetic core members 60*a* equals to the number of the plurality of magnetic core members 60*b*, and the plurality of magnetic core members 60*a* and the plurality of magnetic core members 60*b* are arranged such that the vertical projection image of the plurality of magnetic core members 60*a* and the vertical projection image of the plurality of magnetic core members 60*b* onto the metal strip 1 are overlapped each other in the traveling direction of the metal strip 1.

The divided magnetic core 60 includes the magnetic core member 60*a* on the front surface side and the magnetic core member 60*b* on the back surface side of the metal strip 1, and the magnetic core member 60*e* coupling the ends on the side opposite from the portions covering the metal strip 1 (in the drawing, right side ends) of the magnetic core member 6*a* and the magnetic core member 6*b* as illustrated in FIG. 3B. Note that the non-magnetic coupling member 60*d* may be provided instead of the magnetic core member 60*e* as illustrated in FIG. 3D. Alternatively, as illustrated in FIG. 3C, the magnetic core 60 may be covered with the non-magnetic heat insulating material 60*c*.

The plurality of magnetic core members 60*a* and the plurality of magnetic core members 60*b* are movable forwardly and backwardly in the sheet width direction of the metal strip 1 by the moving member 9 to follow change in the sheet width, and capable of following positional deviation due to snaking or the like of the metal strip 1. Furthermore, the moving member 9 enables a line connecting the side of the magnetic core members 60*a* and magnetic core members 60*b* covering the end in the sheet width direction of the metal strip 1 to be a predetermined profile.

The plurality of magnetic cores 60 is not necessary to be arranged with no gap in the whole width between the vertical projection image of the induction coil member 2*a* on the front surface side of the metal strip 1 onto the metal strip 1 and the vertical projection image of the induction coil member 2*b* on the back surface side of the metal strip 1 onto the metal strip 1, and an appropriate number of magnetic cores 60 may be arranged at predetermined intervals to provide a desired heating temperature distribution.

The line connecting the side of the magnetic core members 60*a* and magnetic core members 60*b* covering the end in the sheet width direction of the metal strip 1 is bent. The plurality of magnetic cores 60 is arranged to cover the end in the sheet width direction of the metal strip 1 in the center area between the induction coil member 2*a* and the induction coil member 2*b*, and is arranged to cover an inside of the metal strip 1 beyond the end in the sheet width direction of the metal strip 1 in the area near the induction coil member 2*a* and the area near the induction coil member 2*b*. The magnetic core members 6*a* and the magnetic core members 6*b* cover a large area of the end in the sheet width direction of the metal strip 1 on the side of each of the induction coil member 2*a* and the induction coil member 2*b*, and cover a small area of the end at the center portion between the induction coil member 2*a* and the induction coil member 2*b*.

Advance/retreat control of the magnetic core members 60*a* and the magnetic core members 60*b* in the sheet width direction gradually suppresses flowing direction of the induction current concentrated at the ends in the sheet width direction of the metal strip 1 to adjust current density and heating period of the current flowing at the ends of the metal strip to prevent overheating at the ends in the sheet width direction of the metal strip 1.

Furthermore, heat generation distribution in the sheet width direction of the metal strip 1 is accurately controlled by freely adjusting the current distribution of the induction current circulating on the sheet surface of the metal strip 1.

For example, when the metal strip 1 is heated by a radiant tube in the stage before using the induction heating device to make the ends of the metal strip be in a high temperature state, making temperature distribution in the sheet width direction of the metal strip even is possible at the exit side of the induction heating device by suppressing calorific value at the ends so as to be smaller than calorific value at the center of the metal strip by suppressing the current flowing at the ends of the metal strip.

In the case of the arrangement of the magnetic cores 60 illustrated in FIG. 5B, the current flowing at the ends in the sheet width direction of the metal strip 1 can be adjusted to some extent by the induction coil members 2*a*, 2*b* themselves, so that the number of the magnetic cores 60 arranged between the induction coil members 2*a*, 2*b* may be smaller as compared with the case of FIG. 5A.

Figure 6:
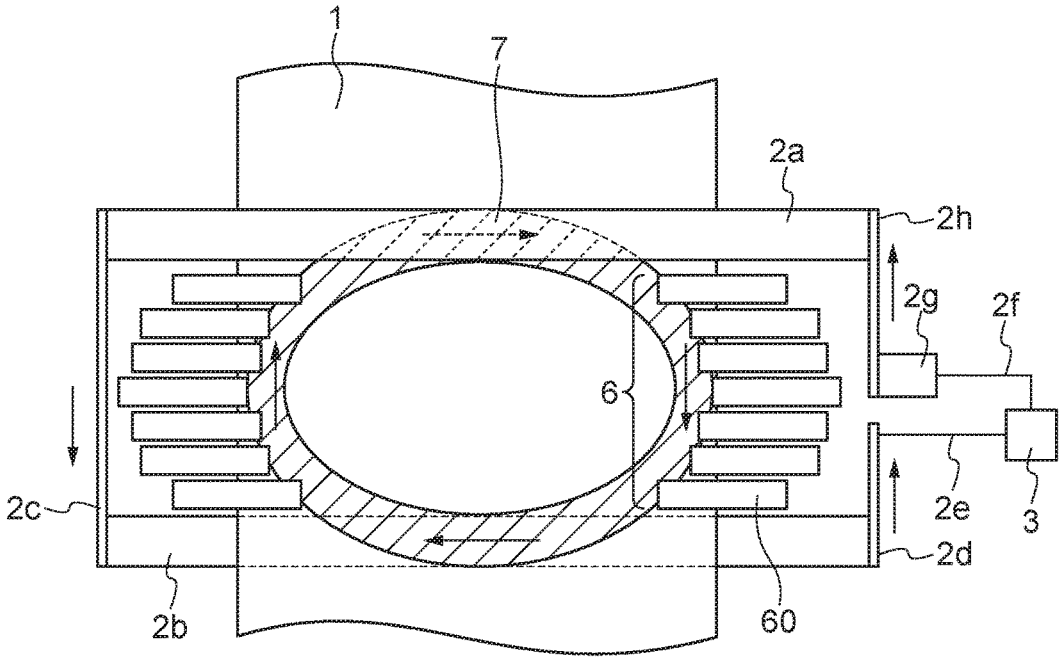
FIG. 6 is a diagram illustrating a circulation mode of induction current circulating in the metal strip.

FIG. 6 illustrates a circulation mode of an induction current 7 generated in the metal strip 1 in the case where the induction coil member 2*a*, the induction coil member 2*b*, and the plurality of magnetic cores 60, which are described with reference to FIG. 5A, are arranged. The induction current 7 generated by the induction coil member 2*a* on the front surface side of the metal strip 1 and the induction coil member 2*b* on the back surface side of the metal strip 1 and suppressed in its concentration to the ends of the metal strip 1 by the plurality of magnetic cores 60 arranged on the both sides of the ends in the sheet width direction of the metal strip 1 elliptically circulates clockwise in the sheet surface of the metal strip 1. In this manner, the plurality of magnetic cores 60 gradually suppresses flowing direction of the induction current concentrated at the ends in the sheet width direction of the metal strip 1 to adjust current density and heating period of the current flowing at the ends of the metal strip 1 to prevent overheating at the ends in the sheet width direction of the metal strip 1.

Note that also in the case where the induction coil member 2*a*, the induction coil member 2*b*, and the plurality of magnetic cores 60 described with reference to FIG. 5B are arranged, the induction current 7 generated by the induction coil member 2*a* on the front surface side of the metal strip 1 and the induction coil member 2*b* on the back surface side of the metal strip 1 and suppressed in its concentration to the ends of the metal strip 1 by the plurality of magnetic cores 60 arranged on the both sides of the ends in the sheet width direction of the metal strip 1 elliptically circulates clockwise in the sheet surface of the metal strip 1. Further, also in the case where the induction coil member 2*a*, the induction coil member 2*b*, and the magnetic cores 6 described with reference to FIG. 4 are arranged, the induction current 7 generated by the induction coil member 2*a* on the front surface side of the metal strip 1 and the induction coil member 2*b* on the back surface side of the metal strip 1 and suppressed in its concentration to the ends of the metal strip 1 by the magnetic cores 6 arranged on the both sides of the ends in the sheet width direction of the metal strip 1 elliptically circulates clockwise in the sheet surface of the metal strip 1.

The arrangement of the plurality of magnetic cores 60 and advance/retreat control of the plurality of magnetic cores 60 do not necessarily need to be symmetric on the both sides in the sheet width direction of the metal strip 1. In the case where temperature distribution is already asymmetric in the sheet width direction of the metal strip 1 at the entrance side of the induction heating device, or in the case where distribution of magnetic field is asymmetric due to snaking, etc., the plurality of magnetic cores 60 does not need to be arranged symmetrically in the sheet width direction of the metal strip 1, and the arrangement thereof may be appropriately changed depending on purpose.

Furthermore, circulation mode of the induction current 7 is not limited to be ellipsoidal, and can be any mode by appropriately changing the entering distances and/or the number of the magnetic cores 60 to be arranged.

So far, the case of one pair of induction coils is described in which the induction coil member 2*a* on the front surface side and the induction coil member 2*b* on the back surface side of the metal strip 1 are coupled, but the inventor confirmed that the above magnetic cores 6 and plurality of magnetic cores 60 effectively function also in the induction heating device in which a plurality of pairs of induction coils is successively arranged.

Figure 7:
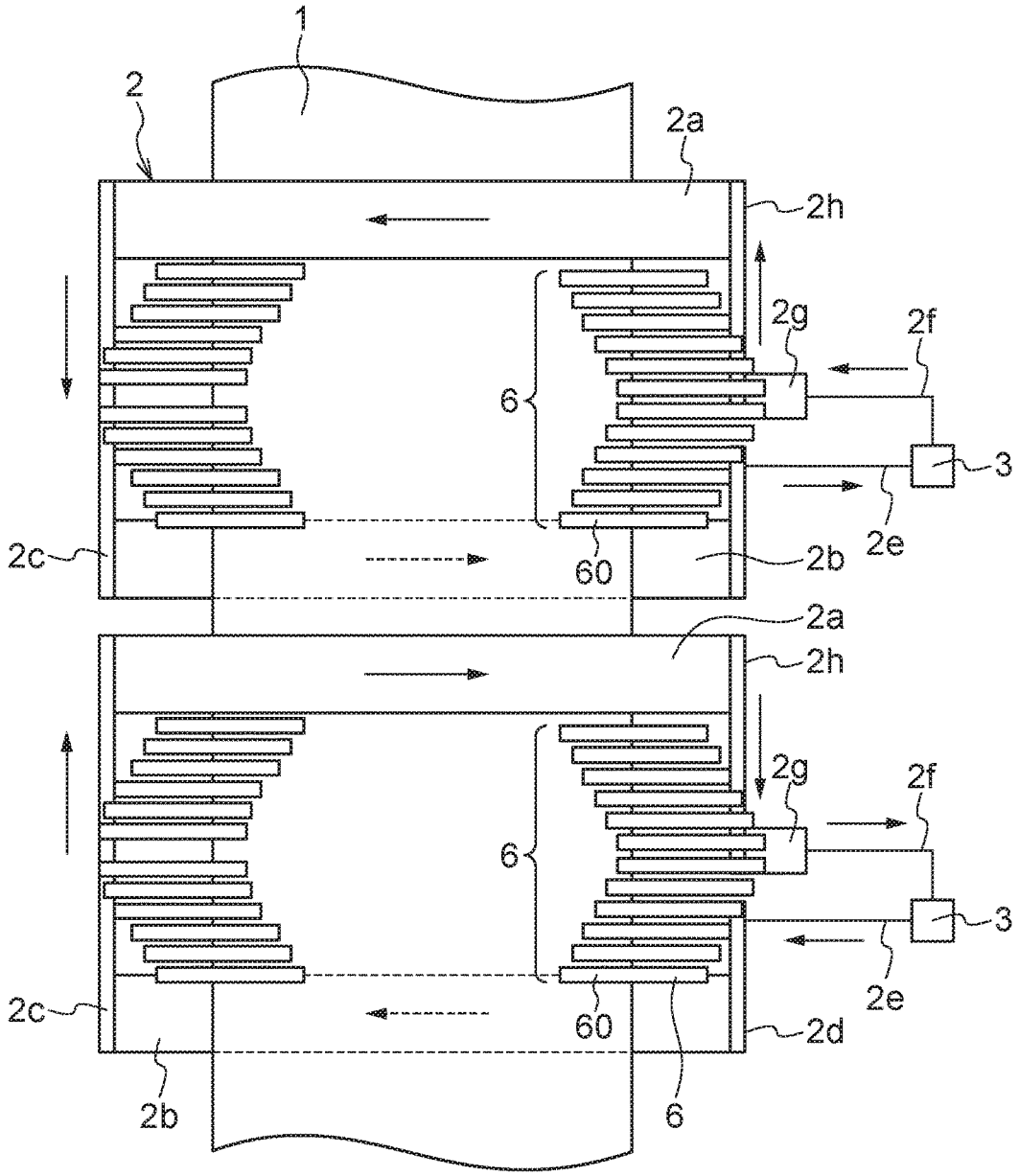
FIG. 7 is a diagram illustrating an arrangement mode of magnetic cores in the case where two pairs of induction coils are adjacently placed in parallel.

FIG. 7 illustrates an arrangement mode of the magnetic cores 60 when two pairs of induction coils 2 are arranged in parallel adjacently. In this case, currents having same phase need to flow in respective the induction coil member 2*b* and the induction coil member 2*a* located at the center. Making the induction coils 2 be placed to align in the traveling direction of the metal strip 1 and making currents having same phase flow in respective the adjacent induction coils 2 increases magnetic flux density at a center portion to relatively increase the ratio of heat generation at the center in the sheet width direction, which makes it possible to reduce degree of overheating at the ends in the sheet width direction, enabling more even heating.

Furthermore, changing outputs of the induction coils 2 of the first stage and second stage allows heating speed to be freely controlled, which makes it possible to heat different temperature areas at different heating speeds, and making it possible to adequately cope with various heating conditions metallurgically required.

Figure 8:
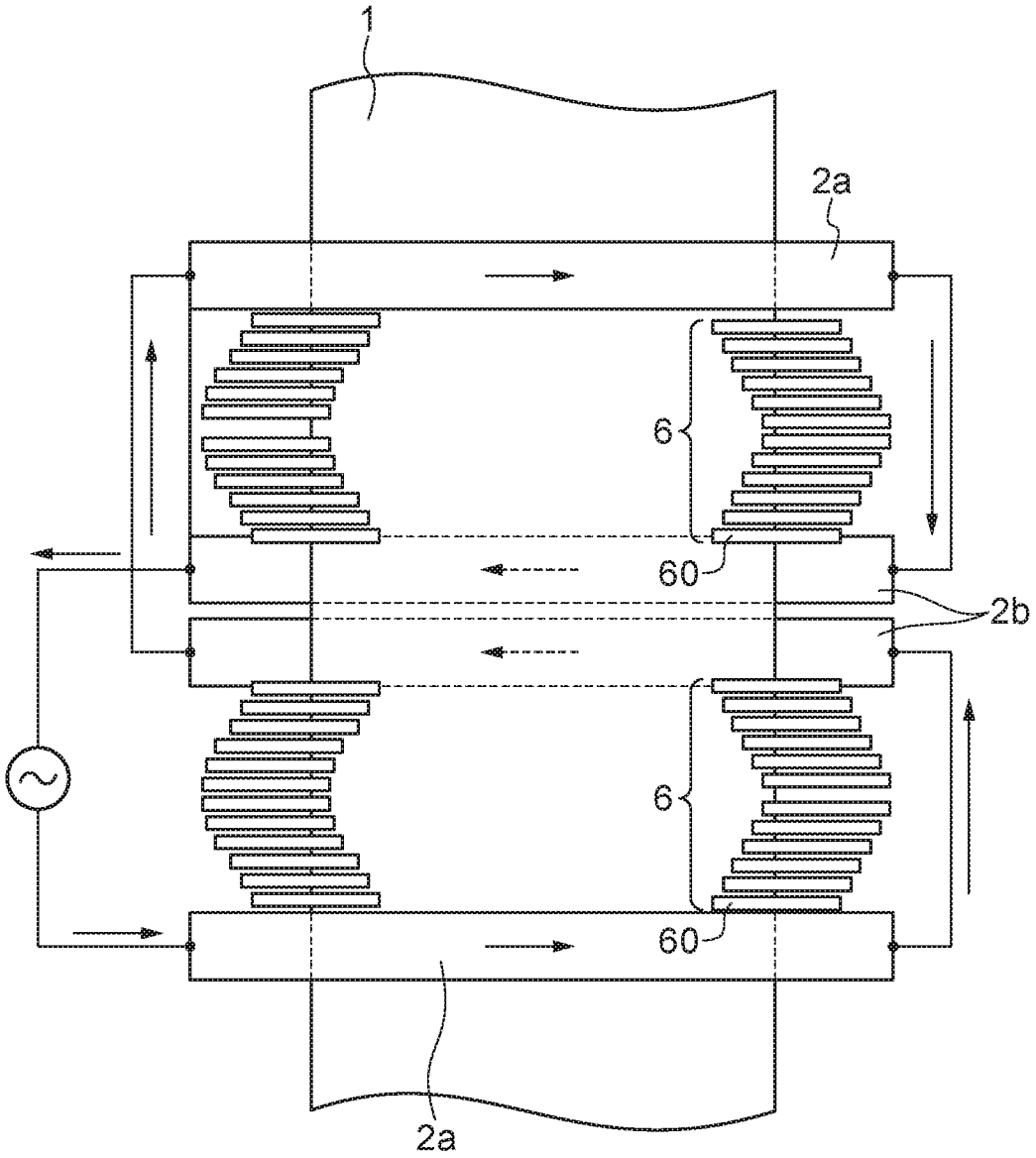
FIG. 8 is a diagram illustrating an arrangement mode of magnetic cores in the case where two pairs of induction coils are coupled by series connection.

FIG. 8 illustrates an arrangement mode of the magnetic cores 60 when two pairs of induction coils 2 are coupled by series connection and arranged. Arranging the induction coils 2 by series connection makes the currents flowing respective the induction coils 2 of the first stage and the second stage become same, making it possible to make the calorific values at respective the induction coils 2 of the first stage and the second stage same.

Figure 9A:
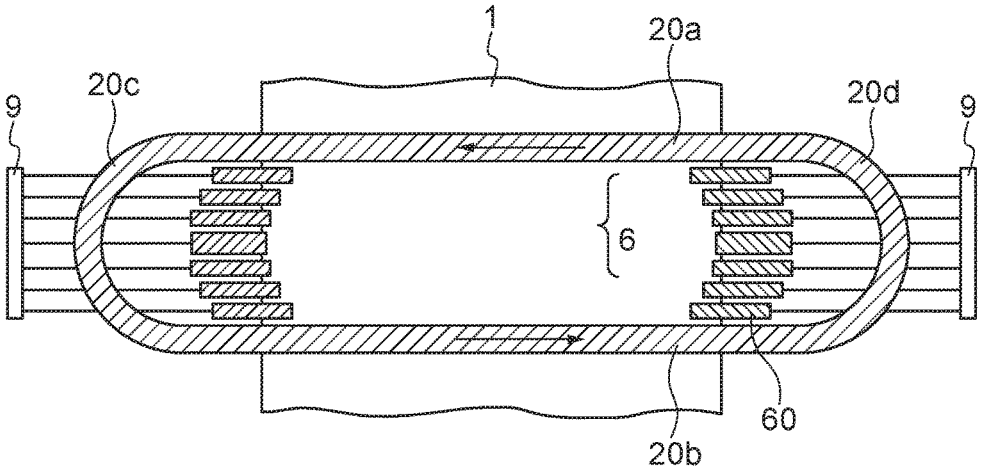
FIG. 9A is a diagram illustrating an arrangement mode of the magnetic core in the embodiments of the description, and is a diagram illustrating a case where the induction coil is of a TF system.

FIG. 9A illustrates an arrangement mode of an induction coil 20 and the magnetic cores 60 in the case of an induction heating device of a TF system.

The induction coil 20 is arranged on the both sides of the front surface side and back surface side of the metal strip 1.

The direction of the current flowing in the induction coil 20 on the front surface side of the metal strip 1 is same as the direction of the current flowing in the induction coil 20 on the back surface side of the metal strip 1. The current flows in the directions shown by the arrows in the drawing.

The induction coil 20 on the front surface side of the metal strip 1 and the induction coil 20 on the back surface side of the metal strip 1 each include an induction coil member 20*a*, an induction coil member 20*b*, an induction coil member 20*c*, and an induction coil member 20*d*. The induction coil member 20*a* and the induction coil member 20*b* are arranged in parallel with the metal strip 1. The both ends of the induction coil member 20*a* and the both ends of the induction coil member 20*b* are protruded from the metal strip 1 in the sheet width direction of the metal strip 1. One end of the induction coil member 20*a* and one end of the induction coil member 20*b* are coupled by the induction coil member 20*c*, and the other end of the induction coil member 20*a* and the other end of the induction coil member 20*b* are coupled by the induction coil member 20*d*. The induction coil member 20*c* is an example of the electrical connector, and the induction coil member 20*d* is also an example of the electrical connector.

The induction coil member 20*a* and the induction coil member 20*b* are arranged such that the vertical projection image that is the vertical projection of the induction coil member 20*a* onto the metal strip 1, and the vertical projection image that is the vertical projection of the induction coil member 20*b* onto the metal strip 1 are not overlapped in the longitudinal direction (traveling direction) of the metal strip 1.

The vertical projection image of the induction coil member 20*a* of the induction coil 20 on the front surface side of the metal strip 1 onto the metal strip 1, and the vertical projection image of the induction coil member 20*a* of the induction coil 20 on the back surface side of the metal strip 1 onto the metal strip 1 are arranged to overlap in the longitudinal direction (traveling direction) of the metal strip 1.

The vertical projection image of the induction coil member 20*b* of the induction coil 20 on the front surface side of the metal strip 1 onto the metal strip 1, and the vertical projection image of the induction coil member 20*b* of the induction coil 20 on the back surface side of the metal strip 1 onto the metal strip 1 are arranged to overlap in the longitudinal direction (traveling direction) of the metal strip 1.

The magnetic core 6 including a plurality of magnetic cores 60 (a plurality of magnetic core members 60*a* and a plurality of magnetic core members 60*b*) has the same configuration as that of the magnetic core 6 including the plurality of magnetic cores 60 (the plurality of magnetic core member 60*a* and the plurality of magnetic core member 60*b*) described with reference to FIG. 5A, and a moving member 9 that makes each of the plurality of magnetic core members 60*a* and the plurality of magnetic core members 60*b* move forwardly and backwardly in the sheet width direction of the metal strip 1 is also identical to the moving member 9 described with reference to FIG. 5A.

Figure 9B:
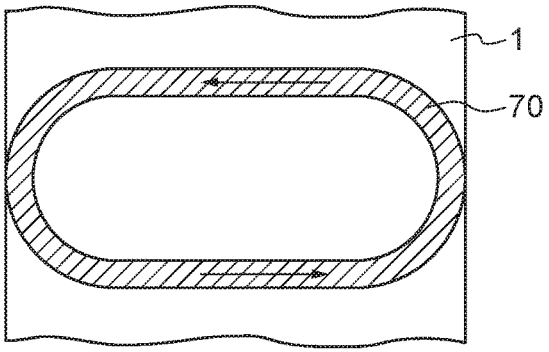
FIG. 9B is a diagram illustrating a circulation mode of induction current circulating in the metal strip in the case of FIG. 9A.
Figure 9C:
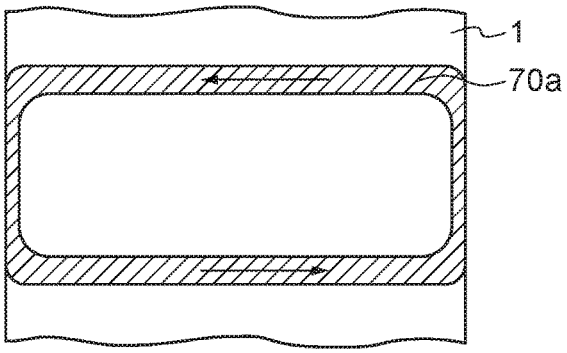
FIG. 9C is a diagram illustrating a circulation mode of induction current circulating in the metal strip in the case where the plurality of magnetic cores is not provided in FIG. 9A.

FIG. 9B illustrates a plane mode of an induction current 70 generated in the metal strip 1 when the magnetic cores 6 as illustrated in FIG. 9A are provided. FIG. 9C illustrates a plane aspect of an induction current 70*a* generated in the metal strip 1 when the magnetic cores 6 illustrated in FIG. 9A are not provided.

Referencing to FIG. 9C, in the metal strip 1 just below the induction coil members 20*a*, 20*b*, the annular induction current 70*a* flowing in the directions of the arrows generates. Overheating readily occurs at the ends in the sheet width direction of the metal strip 1, because, for example, the induction current 70*a* flowing at the ends in the sheet width direction of the metal strip 1 (a) tries to make the reactance between with the primary current flowing in the induction coil member 20*c* or the induction coil member 20*d* coupling the induction coil member 20*a* and the induction coil member 20*b* small to be unfortunately shifted to the ends in the sheet width direction of the metal strip 1, unfortunately narrowing the width d2 of the current path, (b) the magnetic flux generated by the primary current flowing in the induction coil member 20*c* or the induction coil member 20*d* concentrically passing through the ends in the sheet width direction of the adjacent metal strip 1, and (c) at the ends in the sheet width direction of the metal strip 1, as compared with the center of the metal strip 1, heating is performed for a long period by the distance in the longitudinal direction (traveling direction) of the metal strip 1.

In contrast, referencing to FIG. 9B, the plurality of magnetic cores 60 is provided, so that the induction current 70 generated by the induction coil member 20*a* and the induction coil member 20*b* and suppressed in its concentration to the ends of the metal strip 1 by the plurality of magnetic cores 60 arranged at the both sides of the ends in the sheet width direction of the metal strip 1 elliptically circulates in the sheet surface of the metal strip 1. In this manner, the plurality of magnetic cores 60 gradually suppresses flowing direction of the induction current concentrated at the ends in the sheet width direction of the metal strip 1 to adjust the current density and heating period of the current flowing at the ends of the metal strip 1 to prevent overheating at the ends in the sheet width direction of the metal strip 1.

EXAMPLE

Next, an example will be described, but the condition of the example is a conditional example employed to confirm operability and effects of the invention, and the invention is not limited to the conditional example.

Example 1

Electromagnetic field analysis was performed under the following conditions to confirm effects.

Target Material: 0.06% C steel sheet (sheet width 1 m, sheet thickness 1 mm).

Induction Coils: copper sheets having a width of 150 mm were placed to sandwich the steel sheet and such that the copper sheets on the front and back side become in parallel to each other, and vertical projection images thereof onto the steel sheet are separated by 300 mm in inside dimension. The distance between the steel sheet and the induction coils is 10 mm.

Magnetic core A: A magnetic core (made of ferrite) disposed between the induction coil and the induction coil. Width 30 mm, thickness 20 mm, depth 200 mm, inside height 100 mm, and depth 180 mm. Seven cores (one side of steel sheet ends) are arranged at intervals of 10 mm so as to be separated by 15 mm from the induction coils. Relative magnetic permeability is 2000.

Magnetic core B: A magnetic core (made of ferrite) for concentrating magnetic flux mounted on the back surface of the induction coil. Physical properties are same as those of the magnetic core A.

Heating: Heating at 800° C. in non-magnetic area.

Property Values

Steel Sheet: relative magnetic permeability 1 [–], electric conductivity $10^6$ [S/m]

Induction Coils: relative magnetic permeability 1 [–], electric conductivity 0 [S/m]

Magnetic Cores: relative magnetic permeability 2000 [–], electric conductivity 0 [S/m]

Boundary Condition

Periphery Portion: symmetrical boundary

Current: 10 kHz constant current

Analytical Model

Figure 10:
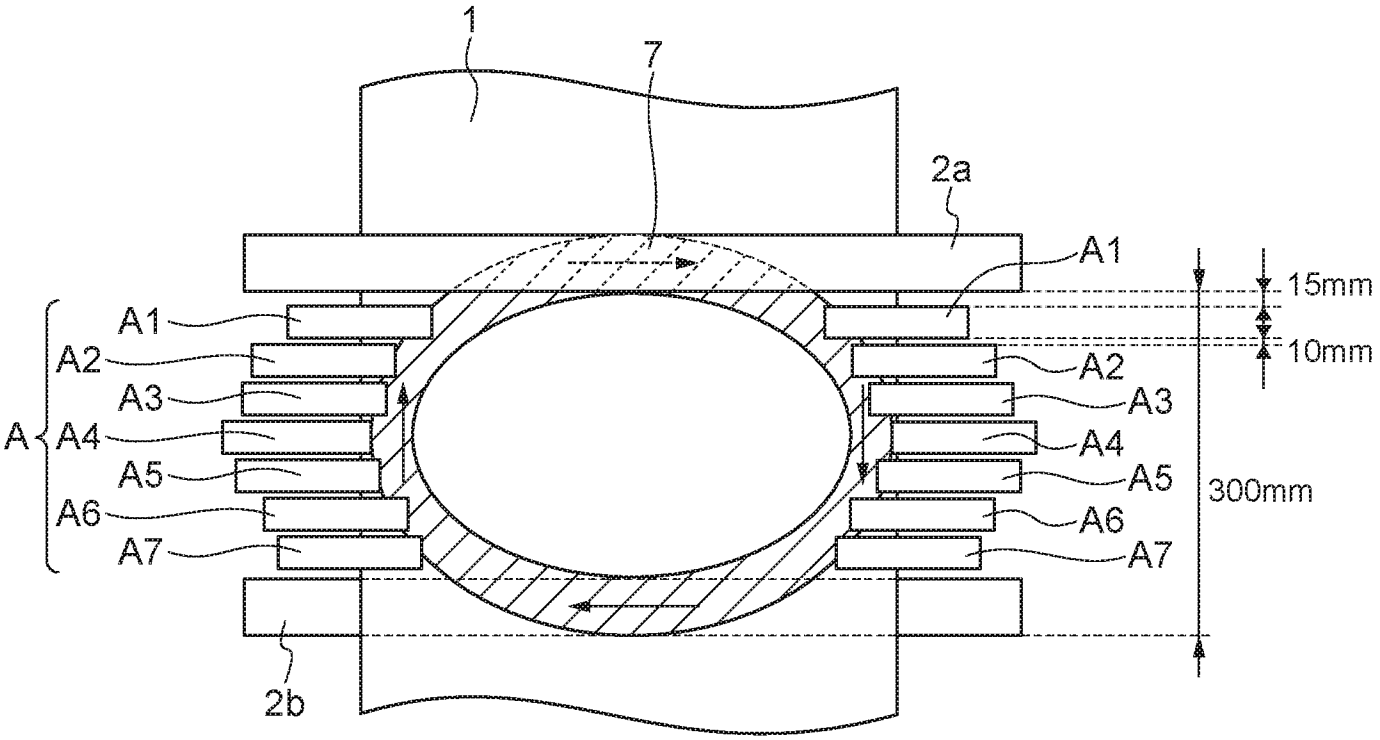
FIG. 10 is a diagram schematically illustrating a configuration of analysis model in an example.

Example: The induction coil members 2*a*, 2*b* laid in the whole sheet width with a gap of 300 mm are placed in parallel on the front surface side and back surface side of the steel sheet 1 and magnetic cores A1 to A7 are arranged on both sides of the ends of the steel sheet and between the two induction coil members 2*a*, 2*b*. FIG. 10 schematically illustrates a configuration of the analytical model of the example.

A circulation mode of the induction current 7 generated by the induction coil member 2*a* (front surface side) and the induction coil member 2*b* (back surface side) was changed by changing entering distances (mm) of the magnetic cores A1 to A7 from steel sheet end, the temperature at the steel sheet end and the temperature at the steel sheet center were calculated, and the temperature ratio=temperature of steel sheet end/temperature of steel sheet center was calculated. Table 1 shows the results.

Figure 11:
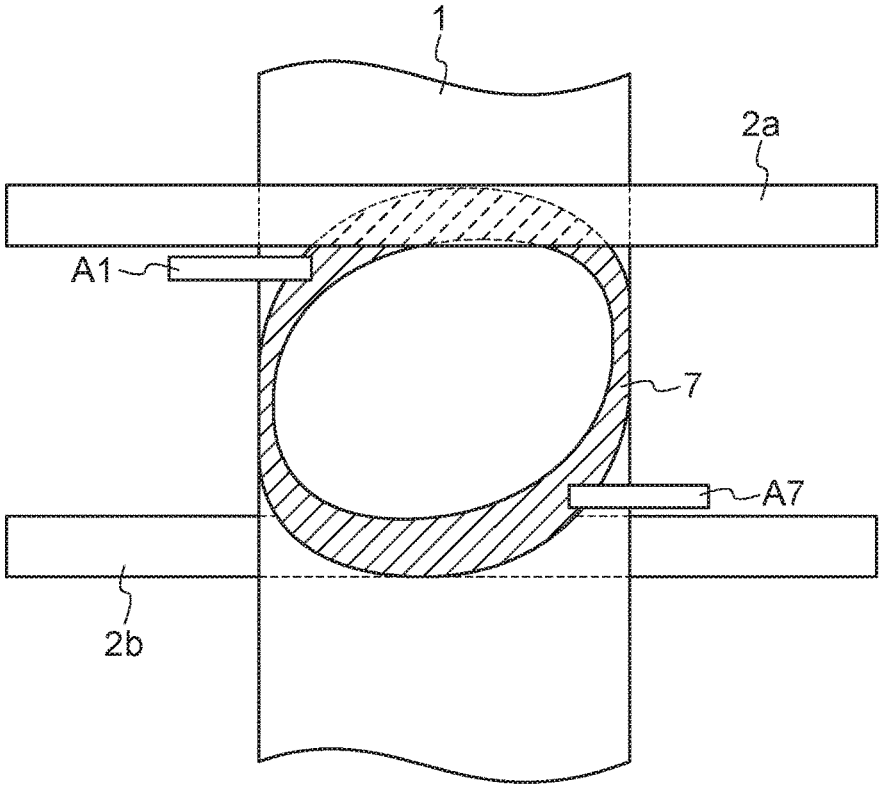
FIG. 11 is a diagram schematically illustrating a configuration of analysis model in Comparative Example 2.
Figure 12:
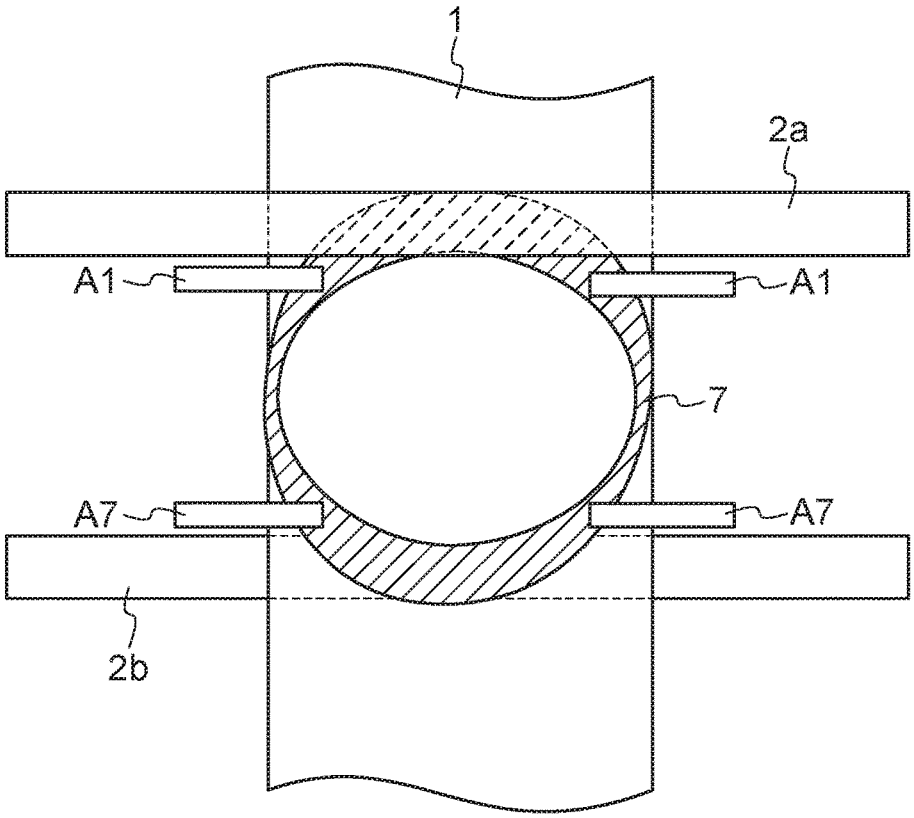
FIG. 12 is a diagram schematically illustrating a configuration of analysis model in Comparative Example 3.

Comparative Examples 1 to 3: The induction coil members 2*a*, 2*b* laid in the whole sheet width with a gap of 300 mm ware placed in parallel on the front surface side and back surface side of the steel sheet 1, and in each of the cases where no magnetic core was arranged on both sides of the ends of the steel sheet and between the two induction coil members 2*a*, 2*b* (Comparative Example 1), where the magnetic core A1 was arranged at one end of the steel sheet 1 and near the induction coil 2*a*, and the magnetic core A7 was arranged at the other end of the steel sheet 1 and near the induction coil member 2*b* (Comparative Example 2), and where the magnetic cores A1, A7 are arranged at each of the both ends of the steel sheet and near the induction coil members 2*a*, 2*b*, respectively (Comparative Example 3), the temperature at the steel sheet end and the temperature at the steel sheet center were calculated, and the temperature ratio=temperature of the steel sheet end/the temperature of steel sheet center was calculated. Table 1 illustrates the results. FIG. 11 and FIG. 12 each schematically illustrate a configuration of the analytical model of Comparative Example 2 and Comparative example 3, respectively.

TABLE 1

| | Temperature ratio (= end temperature/ center temperature) |
|---|---|
| Example of the invention | 1.08 |
| Comparative Example 1 | 7.3 |
| Comparative Example 2 | 5.2 |
| Comparative Example 3 | 3.0 |

The temperature ratios illustrated in Table 1 show that temperature distribution in the sheet width direction of the steel sheet was largely improved to be homogenized.

According to the embodiments of the above description, it is possible to control the induction current flowing on end sides in the sheet width direction of the metal strip and to freely control temperature distribution of the metal strip in the sheet width direction regardless of magnetic or non-magnetic also when the sheet thickness is thin.

Furthermore, according to the embodiments of the description, it is possible to freely correct temperature distribution so as to be desired temperature distribution during heating the metal strip also in the case where the metal strip is heated before entering in the induction heating device and a large deviation exists in temperature distribution of the metal strip, thereby making it possible to improve heat processing quality of the metal strip.

Furthermore, according to the embodiments of the description, heating is possible without lowering heating rate also in the temperature area where temperature exceeds Curie point at which heat transfer becomes difficult as a heated material becomes high temperature by radiation heating, thereby making it possible to improve productivity to dramatically improve flexibility of schedule of production.

The disclosure of Japanese Patent Application No. 2014-181710 filed on Sep. 5, 2014 in its entirety is hereby incorporated by reference.

All the documents, patent applications, and technical standards described in the present description are hereby incorporated by reference to the same extent as in cases where each document, patent application, or technical standard is specifically and individually described as being incorporated by reference.

Although various typical embodiments are described above, the present invention is not limited to the embodiments. The scope of the present invention is limited only by the following claims.

The invention claimed is:

1. An induction heating device for a metal strip, comprising:

a first induction coil including:

a first induction coil member and a second induction coil member that are provided in parallel with a metal strip across the metal strip that travels in a longitudinal direction thereof, that are provided such that both ends of each of the first induction coil member and the second induction coil member protrude from the traveling metal strip in a sheet width direction of the traveling metal strip, and that are arranged such that vertical projection images thereof onto the traveling metal strip do not overlap each other in a traveling direction in which the metal strip travels;

a first electrical connector for electrically connecting one of both ends of the first induction coil member and one of both ends of the second induction coil member; and a second electrical connector for electrically connecting another one of the both ends of the first induction coil member and another one of the both ends of the second induction coil member;

a first magnetic core including:

a first magnetic core member provided between the first induction coil member and the second induction coil member in the traveling direction, the first magnetic core member being provided on one of surface sides of the traveling metal strip and covering a large area of one end portion in the sheet width direction of the traveling metal strip, the large area being on one end portion in the sheet width direction of the traveling metal strip at a side of each of the first induction coil member and the second induction coil member in the traveling direction of the metal strip between the first induction coil member and the second induction coil member, and covering a small area of the one end portion in the sheet width direction of the traveling metal strip at a center portion in the traveling direction of the metal strip between the first induction coil member and the second induction coil member;

wherein two end portions of the first magnetic core member that are proximate to the respective first and second induction coils have a larger surface area that covers the metal strip over the large area than a surface area of a portion of the first magnetic core member that covers the small area at the center portion of the metal strip, and a second magnetic core member provided between the first induction coil member and the second induction coil member in the traveling direction, the second magnetic core member being provided on another one of the surface sides opposite from the one of the surface sides of the traveling metal strip and covering a large area of the one end portion in the sheet width direction of the traveling metal strip, the large area being on one end portion in the sheet width direction of the traveling metal strip at a side of each of the first induction coil member and the second induction coil member in the traveling direction of the metal strip between the first induction coil member and the second induction coil member, and covering a small area of the one end portion in the sheet width direction of the traveling metal strip at a center portion in the traveling direction of the metal strip between the first induction coil member and the second induction coil member;

wherein two end portions of the second magnetic core member that are proximate to the respective first and second induction coils have a larger surface area that covers the metal strip over the large area than a surface area of a portion of the second magnetic core member that covers the small area at the center portion of the metal strip, and a second magnetic core including:

a third magnetic core member provided between the first induction coil member and the second induction coil member in the traveling direction, the third magnetic core member being provided on the one of the surface sides of the traveling metal strip and covering a large area of another end portion opposite from the one end portion in the sheet width direction of the traveling metal strip, the large area being on one end portion in the sheet width direction of the traveling metal strip at a side of each of the first induction coil member and the second induction coil member in the traveling direction of the metal strip between the first induction coil member and the second induction coil member, and covering a small area of the one end portion in the sheet width direction of the traveling metal strip at a center portion in the traveling direction of the metal strip between the first induction coil member and the second induction coil member;

wherein two end portions of the third magnetic core member that are proximate to the respective first and second induction coils have a larger surface area that covers the metal strip over the large area than a surface area of a portion of the third magnetic core member that covers the small area at the center portion of the metal strip, and a fourth magnetic core member provided between the first induction coil member and the second induction coil member in the traveling direction, the fourth magnetic core member being provided on the another one of the surface sides of the traveling metal strip and covering a large area of the another end portion in the sheet width direction of the traveling metal strip, the large area being on one end portion in the sheet width direction of the traveling metal strip at a side of each of the first induction coil member and the second induction coil member in the traveling direction of the metal strip between the first induction coil member and the second induction coil member, and covering a small area of the one end portion in the sheet width direction of the traveling metal strip at a center portion in the traveling direction of the metal strip between the first induction coil member and the second induction coil member wherein two end portions of the fourth magnetic core member that are proximate to the respective first and second induction coils have a larger surface area that covers the metal strip over the large area than a surface area of a portion of the fourth magnetic core member that covers the small area at the center portion of the metal strip.

2. The induction heating device for a metal strip according to claim 1, wherein the first induction coil member is provided on the one of the surface sides of the traveling metal strip, and the second induction coil member is provided on the another one of the surface sides of the traveling metal strip.

3. The induction heating device for a metal strip according to claim 1, further comprising a second induction coil including:

a third induction coil member and a fourth induction coil member that are provided in parallel with the metal strip across the metal strip that travels in the longitudinal direction thereof, that are provided such that both ends of each of the third induction coil member and the fourth induction coil member protrude from the traveling metal strip in the sheet width direction of the traveling metal strip, and that are arranged such that vertical projection images thereof onto the traveling metal strip do not overlap each other in the traveling direction in which the metal strip travels;

a third electrical connector for electrically connecting one of both ends of the third induction coil member and one of both ends of the fourth induction coil member; and a fourth electrical connector for electrically connecting another one of the both ends of the third induction coil member and another one of the both ends of the fourth induction coil member, wherein vertical projection images of the first induction coil member and the third induction coil member onto the traveling metal strip in the thickness direction of the metal strip overlap each other in the traveling direction in which the metal strip travels, and vertical projection images of the second induction coil member and the fourth induction coil member onto the traveling metal strip in the thickness direction of the metal strip overlap each other in the traveling direction in which the metal strip travels, and wherein the first induction coil member and the second induction coil member are provided on the one of the surface sides of the traveling metal strip, and the third induction coil member and the fourth induction coil member are provided on the another one of the surface sides of the traveling metal strip.

4. The induction heating device for a metal strip according to claim 1, wherein the first magnetic core member and the second magnetic core member each are divided into a same number of a plurality of members in the traveling direction, and the plurality of divided first magnetic core members and the plurality of divided second magnetic core members are arranged such that vertical projection images of the divided first magnetic core members and vertical projection images of the divided second magnetic core members onto the traveling metal strip in the thickness direction of the metal strip respectively overlap each other in the traveling direction, in which the metal strip travels and the third magnetic core member and the fourth magnetic core member each are divided into a same number of a plurality of members in the traveling direction, and the plurality of divided third magnetic core members and the plurality of divided fourth magnetic core members are arranged such that that vertical projection images of the divided third magnetic core members and vertical projection images of the divided fourth magnetic core members onto the traveling metal strip in the thickness direction of the metal strip respectively overlap each other in the traveling direction, in which the metal strip travels.

5. The induction heating device for a metal strip according to claim 4, further comprising: a carriage for holding the magnetic core with a driving device configured to move each of the divided plurality of members of the first magnetic core member and the second magnetic core member, and each of the divided plurality of members of the third magnetic core member and the fourth magnetic core member in the sheet width direction of the traveling metal strip.

6. The induction heating device for a metal strip according to claim 2, further comprising:

a second induction coil having a structure identical to a structure of the first induction coil;

a third magnetic core having a structure identical to a structure of the first magnetic core; and a fourth magnetic core having a structure identical to a structure of the second magnetic core, wherein the first induction coil and the second induction coil are arranged in parallel in the traveling direction.

* * * * *